US005081488A

United States Patent [19]

Suzuki

[11] Patent Number: 5,081,488

[45] Date of Patent: Jan. 14, 1992

[54] IMAGE FORMING APPARATUS

[75] Inventor: Hajime Suzuki, Yokohama, Japan

[73] Assignee: Canon Kabushiki Kaisha, Tokyo, Japan

[21] Appl. No.: 574,043

[22] Filed: Aug. 29, 1990

[30] Foreign Application Priority Data

Aug. 31, 1989 [JP] Japan ..... 1-225488

[51] Int. Cl.[5] ..... G03G 15/00

[52] U.S. Cl. ..... 355/200; 355/271; 355/326; 74/665 GA; 29/115; 29/123

[58] Field of Search ..... 355/200, 210, 211, 213, 355/271, 272, 274, 326; 74/665 GA; 29/115, 123

[56] References Cited

U.S. PATENT DOCUMENTS 4,298,278 11/1981 Katakura et al. ..... 355/85
4,425,036 1/1984 Kameyama et al. ..... 355/200
4,829,335 5/1989 Kanemitsu et al. ..... 355/211
4,872,037 10/1989 Kasahara et al. ..... 355/271

FOREIGN PATENT DOCUMENTS 60-192934 10/1985 Japan .

*Primary Examiner*—R. L. Moses
*Attorney, Agent, or Firm*—Fitzpatrick, Cella, Harper & Scinto

[57] ABSTRACT

The present invention relates to an image forming apparatus having a recording medium bearing drum, characterized by a connector member for interconnecting a pair of ring members constituting the recording medium bearing drum, and a drive transmitting device for transmitting the driving force from one to the other of the ring members is disposed inside the recording medium bearing drum.

28 Claims, 8 Drawing Sheets

IMAGE FORMING APPARATUS

BACKGROUND OF THE INVENTION

1. Field of the Invention

The present invention relates to an image forming apparatus such as an electrophotographic or electrostatic recording apparatus, and more particularly, it relates to an image forming apparatus wherein a recording medium bearing means for transferring a toner image formed on an image bearing member onto a recording medium has a specific feature and which is applicable to a multi-color image forming apparatus such as a multi-color or full-color electrophotographic copying machine, printer or the like.

2. Related Background Art

A color image forming apparatus in which toner images are successively formed by toner having a plurality of colors on an image bearing member constituted by a rotary cylinder, endless belt or the like while rotating the image bearing member continuously, and these toner images are successively transferred onto a recording medium carried by an recording medium bearing means at a recording position where the image bearing member and the recording medium bearing means are opposed, thereby obtaining a color image has been already known.

FIG. 8 shows an exemplary conventional color electrophotographic copying machine.

In FIG. 8, the color electrophotographic copying machine is so designed as to form electrostatic latent images on an electrophotographic photosensitive drum 100 acting as an image bearing member by means of a charging means 200 and an exposure means 300, to change the latent image into color toner images by means of a horizontally shiftable developing means 400 including a plurality of developing devices 400Y, 400M, 400C and 400BK including, for example, yellow toner, magenta toner, cyan toner and black toner, respectively, and to transfer these color images in the superimposing fashion onto a sheet-shaped transfer material P such as a paper electrostatically attached to a transfer material bearing device 1 acting as a drum-shaped recording medium bearing means disposed in the vicinity of the photosensitive drum 100, thereby obtaining a color image.

As briefly shown in FIG. 7, the transfer material bearing drum is constituted by integrally connecting a pair of coaxial ring members 1*a* and 1*b* by means of a connector member 1*c* and by covering these elements 1*a*, 1*b*, 1*c* with a flexible dielectric sheet 3.

Transfer material gripping means 4 are provided on the connector member 1*c* of the transfer drum 1 so constructed, so that a leading edge of the transfer material P fed from a cassette (not shown) in the timed relation to the toner images on the photosensitive drum 100 is gripped by the gripping means 4. The transfer drum 1 gripping the transfer material P approaches the transfer material to the photosensitive drum 100 and releases the transfer material P after the color toner images have been transferred onto the transfer material to form the color image. The transfer material P separated from the transfer drum 1 by means of a separating means 500 including a separating charger, separating pawl and the like is fed to a fixing means 700 by a conveying means 600, where the toner image is fixed on the transfer material.

As shown in FIG. 7, the operation of the transfer drum 1 is affected by a gear 14 rotated integrally with the ring member 1*a* of the transfer drum 1 and meshed with a gear 13 rotated integrally with the photosensitive drum 100, and the rotating force is transmitted from the ring member 1*a* to the ring member 1*b* through the connector member 1*c*.

In general, the transfer drum 1 is so designed that it can be manually moved toward and away from the photosensitive drum 100 so that, when they are separated, the gear 14 is disengaged from the gear 13 to manually rotate the transfer drum 1 freely, thereby permitting easier unjamming treatment when the transfer material is jammed.

Heretofore, a plurality of transfer materials were rarely carried by the transfer drum 1 having the above-mentioned arrangement simultaneously. Thus, the connector member 1*c* had a dimension sufficient to keep the rigidity of the drum and, the rotational driving force could be transmitted from the ring member 1*a* to the ring member 1*b* only through the connector member 1*c*.

However, in the transfer drum 1 having such arrangement, if it is desired that the diameter of the drum is reduced or a plurality of transfer sheets are carried by the transfer drum, the connector member 1*c* sometimes could not provide the sufficient rigidity of the drum.

Further, as shown in FIG. 7, when the transfer drum 1 is driven, the connector member 1*c* is always subjected to the rotational driving force, the inertia moment of the ring member 1*b* and a component (F) of force in a rotational direction of a load such as a load generated due to the sliding action in bearing portions, thus twisting the connector member 1*c*.

If the connector member 1*c* cannot provide the sufficient rigidity of the transfer drum as mentioned above, such twist or torsion of the connector member will be greater.

Accordingly, if a plurality of transfer materials are subjected to the image transfer treatment continuously, the image formed on the later transfer material will be more distorted or extended at the ring member 1*b*, in comparison with the image formed on the first transfer material. Further, the twist or torsion of the connector member 1*c* affects a bad influence upon the dielectric sheet or transfer material bearing sheet 3 so that the blank portion and/or color deviation occur in the transferred image and that the service life of the transfer material bearing sheet is decreased.

Thus, it was practice that the connector member 1*c* was made of material having the greater strength and was designed to have the wider area. However, this increases the production cost of the transfer drum and limits the size and/or number of the transfer materials to be born by the drum.

SUMMARY OF THE INVENTION

The present invention aims to eliminate the above-mentioned conventional drawbacks, and an object of the present invention is to prevent a connector member connecting a pair of ring members constituting a recording medium bearing means from being twisted.

Another object of the present invention is to provide a recording medium bearing means which can bear or carry a plurality of recording mediums.

A further object of the present invention is to obtain an image with high quality.

Other objects and features of the present invention will be apparent from the following explanations described with reference to the accompanying drawings.

DETAILED DESCRIPTION OF THE PREFERRED EMBODIMENTS

The present invention will now be fully explained in connection with embodiments thereof with reference to the accompanying drawings.

The present invention can be embodied as a full-color electrophotographic copying machine as already described in connection with FIG. 8. Incidentally, the present invention is applicable to an image forming apparatus (such as, for example, bubble jet or ink jet image forming apparatus) and other apparatuses wherein an image is directly recorded on a recording medium born or carried by a recording medium bearing means without using any image bearing means.

Figure 8:
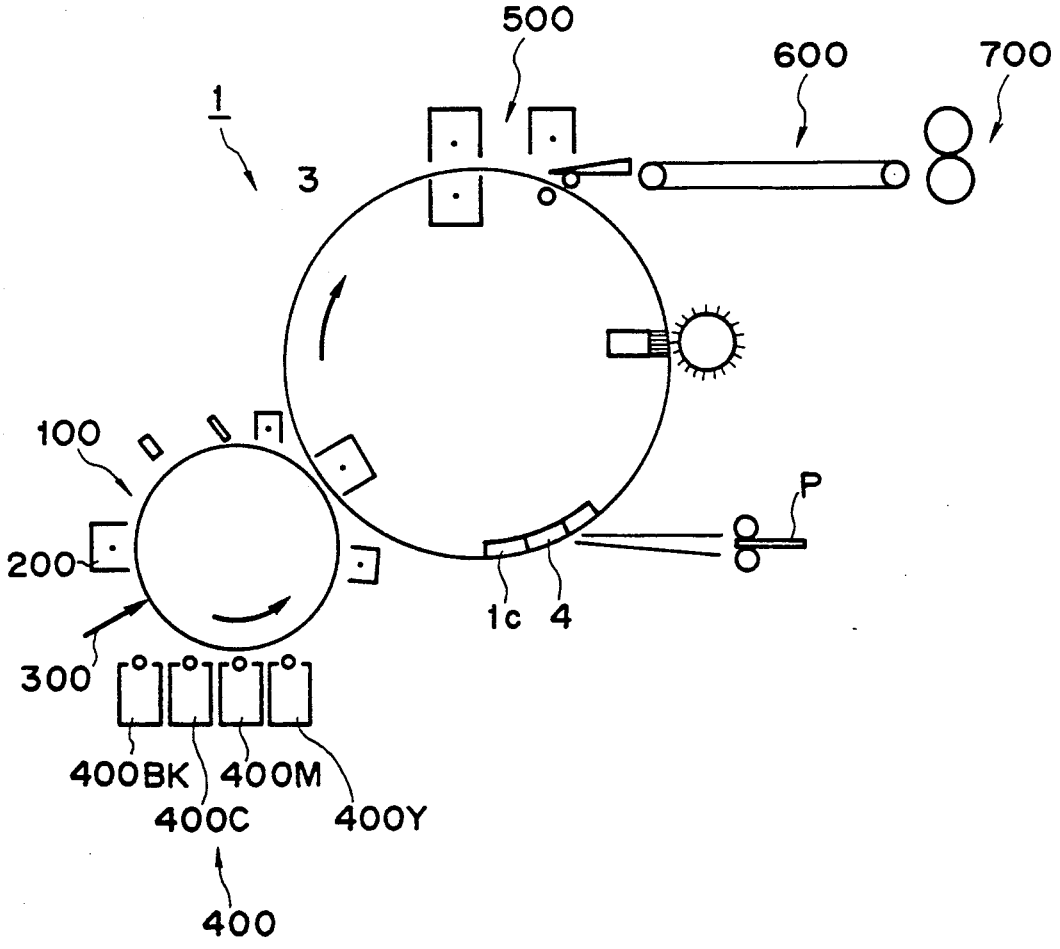
FIG. 8 is a schematic constructional view of an image forming apparatus according to an embodiment of the present invention.

The present invention has a characteristic in its recording medium bearing device, and other parts may have the same construction as those of the copying machine as shown in FIG. 8. Thus, a transfer material bearing device acting as the recording medium bearing device will be fully explained hereinafter.

Figure 1:
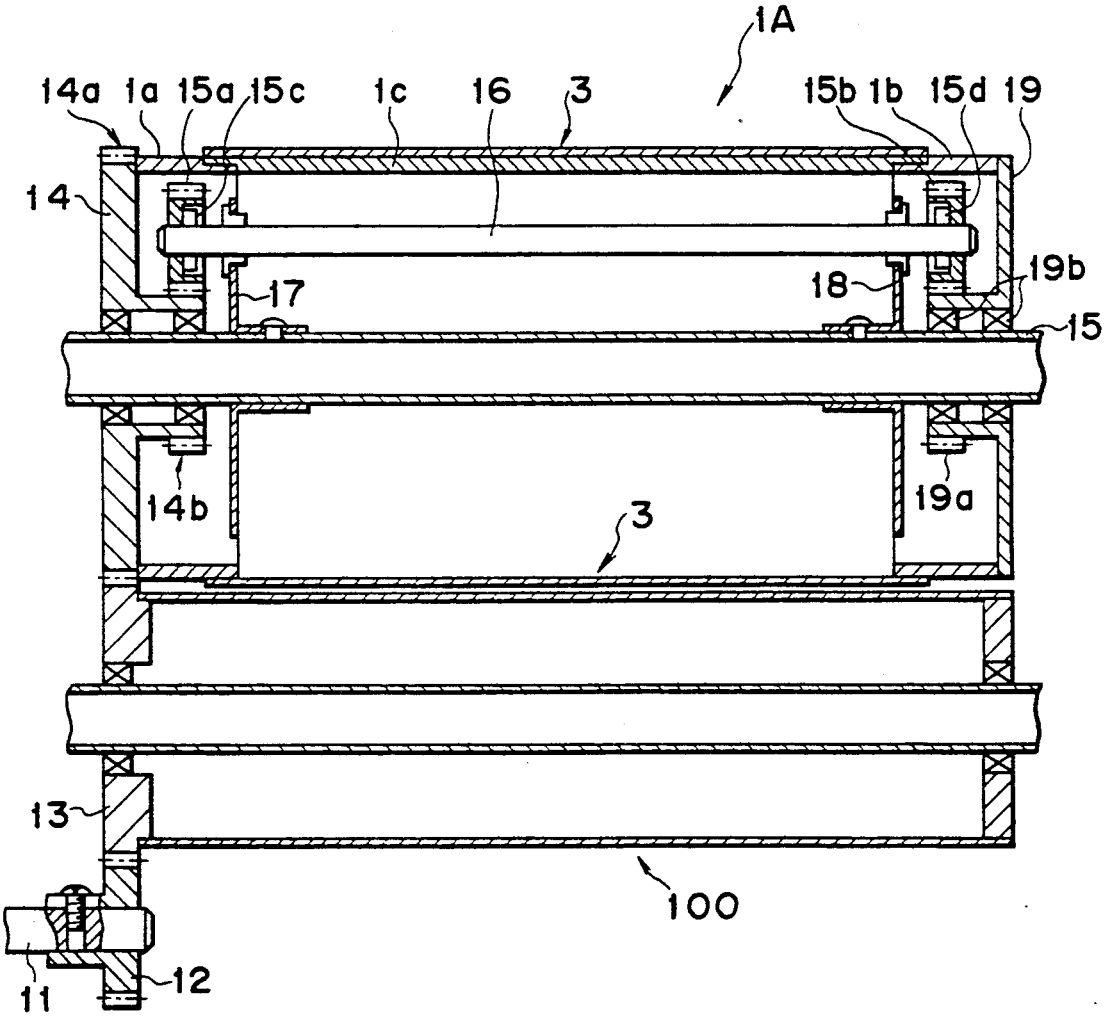
FIG. 1 is a sectional view of a recording medium bearing device according to a preferred embodiment of the present invention.

FIG. 1 shows such transfer material bearing device 1A according to an embodiment of the present invention. In this embodiment, the transfer drum has the same construction as that of the conventional one shown in FIG. 7, and thus, comprises a pair of left and right coaxial ring members 1*a*, 1*b*, a connector member 1*c* connecting the ring members 1*a* and 1*b* integrally, and a flexible dielectric sheet 3 covering these elements 1*a*–1*c*. Incidentally, the flexible sheet may be a mesh-shaped sheet and the like which can bear or carry a transfer material P. Further, in the transfer drum, the ring members 1*a*, 1*b* and the connector member 1*c* may be integrally formed as a single unit.

A transfer drum gear 14 is integrally fixed to the ring member 1*a* at one side of the transfer drum 1, and a flange 19 is integrally formed on the ring member 1*b* at the other side of the transfer drum. The transfer drum gear 14 and the flange 19 are rotatably supported on a shaft 15 disposed at the center of the transfer drum 1.

The transfer drum gear 14 is meshed with a photosensitive drum gear 13 formed integrally with a photosensitive drum 100. Further, the photosensitive drum gear 13 is meshed with a driving gear 12 which is in turn fixed, by screws, to a driving shaft 11 driven by a driving motor (not shown). Thus, the rotational force from the driving motor is transmitted to the transfer drum gear 14 through the photosensitive drum gear 13 and the driving gear 12.

Explaining further, the transfer drum gear 14 has a two-stage gear construction including a larger diameter gear portion 14*a* meshed with the photosensitive drum gear 13 and a smaller diameter gear portion 14*b*. As mentioned above, the transfer drum gear 14 is fixed to the ring member 1*a* and serves to transmit the driving force obtained from the photosensitive drum gear 13 to the other ring member 1*b* through the connector member 1*c*. Thus, the transfer drum gear 14, ring member 1*a*, connector member 1*c* and the like constitutes a driving force transmitting means for the ring member 1*b*.

Further, within the transfer drum, brackets 17 and 18 are fixed, by screws, to the shaft 15, and processing means such as a transfer charger (not shown) and the like are fixedly mounted between these brackets 17, 18.

In addition, within the transfer drum 1, an idler shaft 16 is rotatably supported in parallel with the shaft 15, which idler shaft 16 is provided at its both ends with idler gears 15*a*, 15*b* fixed thereto by pins 15*c*, 15*d*. The idler gear 15*a* is meshed with the smaller diameter gear portion 14*b* of the transfer drum gear 14, and the idler gear 15*b* is meshed with a gear 19*a* formed on the flange 19 fixed to the end of the ring member 1*b*. These elements also constitute the driving force transmitting means.

Next, the operation of the transfer drum having the above-mentioned construction will be explained.

The driving force from the driving motor is transmitted to the ring member 1*b* through the photosensitive drum gear 13, transfer drum gear 14, ring member 1*a* and connector member 1*c*. Further, according to the present invention, the rotational driving force from the driving motor is also transmitted to the ring member 1*b* through the driving force transmitting means of the present invention (idler gears 15*a*, 15*b* and idler shaft 16).

Figure 2:
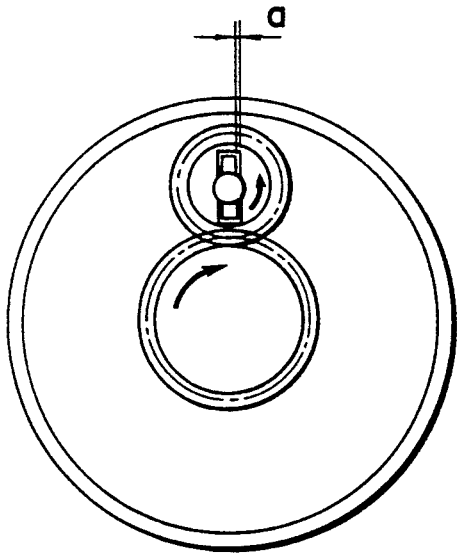
FIG. 2 is a side view of gear portions of the device of FIG. 1.

In this case, the force transmission through the driving force transmitting means of the present invention does not interfere with the force transmission through the connector member 1*c*, because the driving force transmitting means has the backlash between the gears and clearances a (FIG. 2) between the pins 15*c*, 15*d* and pin receiving holes to delay the transmission of the driving force.

Figure 7:
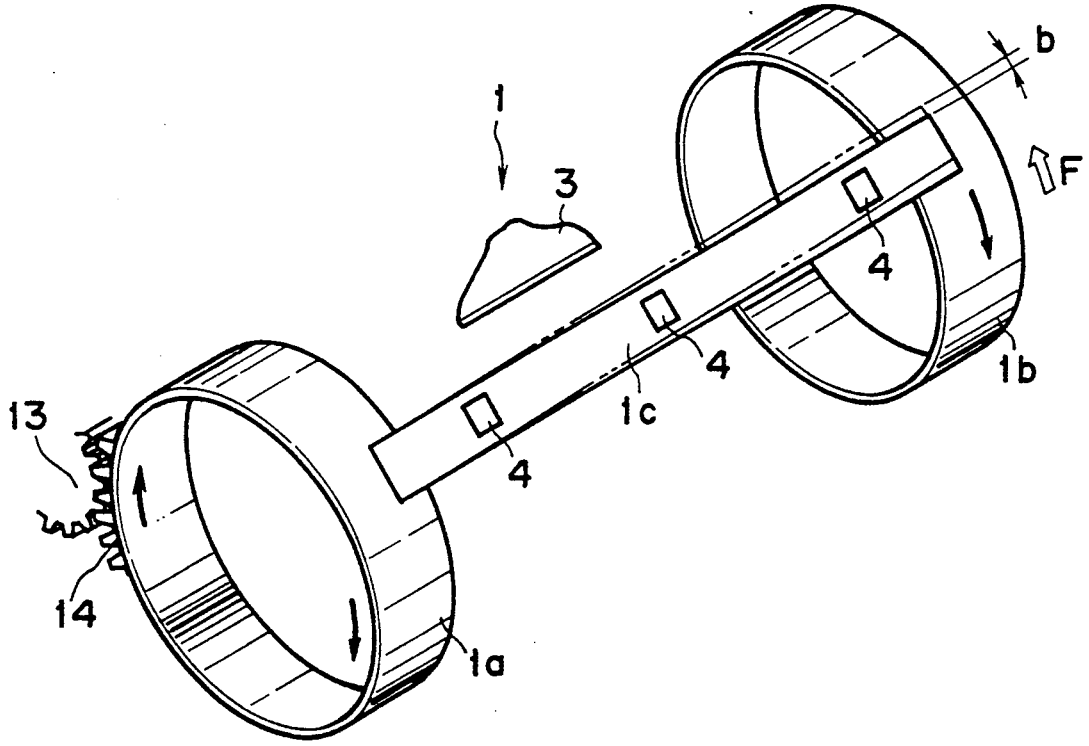
FIG. 7 is a fragmental perspective view of a conventional recording medium bearing device.

However, even in this case, the connector member 1*c* is gradually twisted in a direction opposite to the rotational direction of the transfer drum, as is the case shown in FIG. 7, due to the inertia moment of the ring member 1*b* and/or the sliding load (increasing during use) in bearing portions 19*b* for the flange 19. This torsion not only affects a bad influence upon the connector member 1*c* but also generates the strain in the dielectric sheet 3, which are very disadvantageous upon the formation of the image.

However, since the torsion or deformation of the connector member 1*c* can be limited within a range b, it is difficult for the connector member to further deform. Since deformation amount b is determined by the backlash between the gears and the clearances a between the pins and the pin receiving holes, the deformation amount can be minimized by changing the setting values of the backlash and/or clearance. However, since the backlash between the gears and the clearance a between the pin and the pin receiving hole cannot be eliminated completely, other correction is required.

Figure 3:
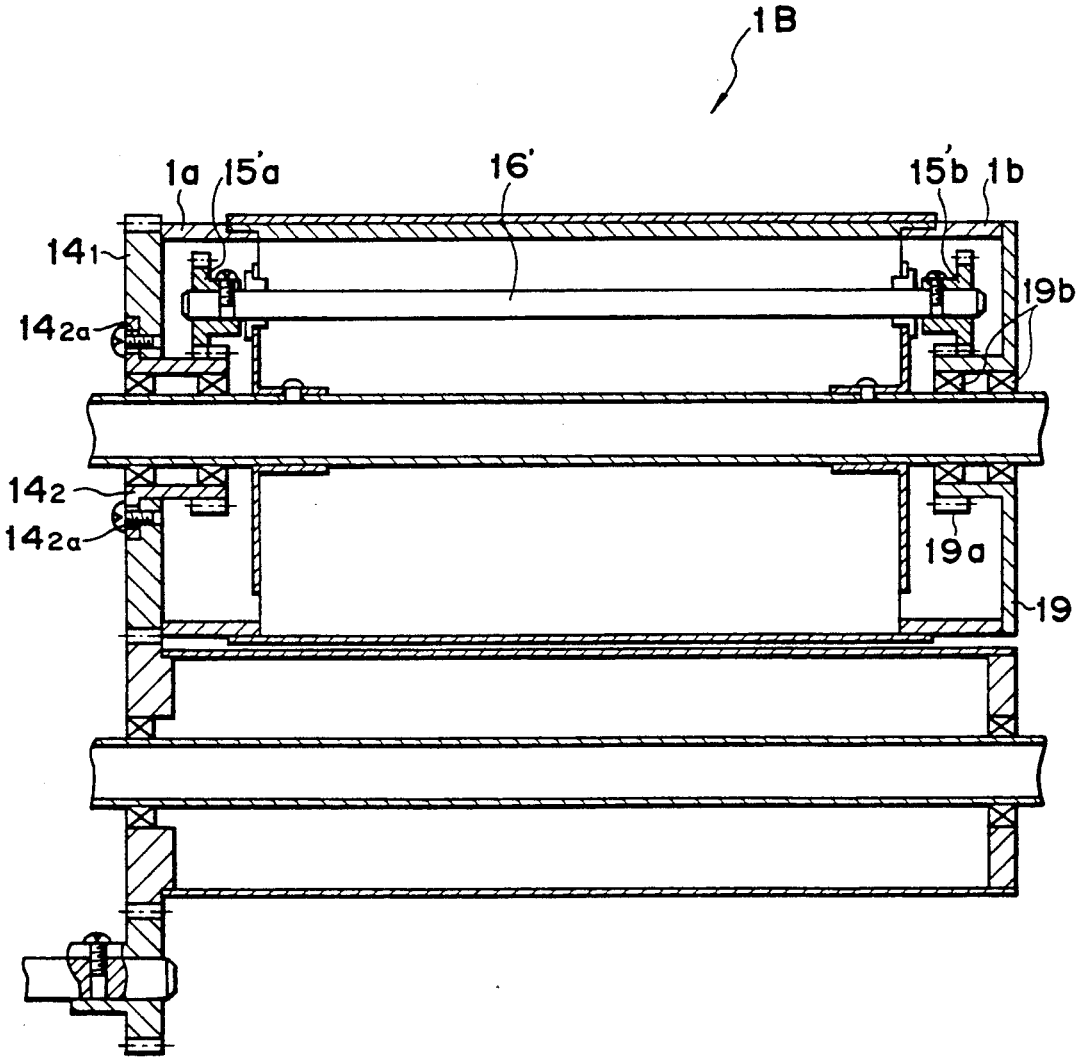
FIG. 3 is a sectional view of a driving mechanism for the recording medium bearing device according to a first embodiment.
Figure 4:
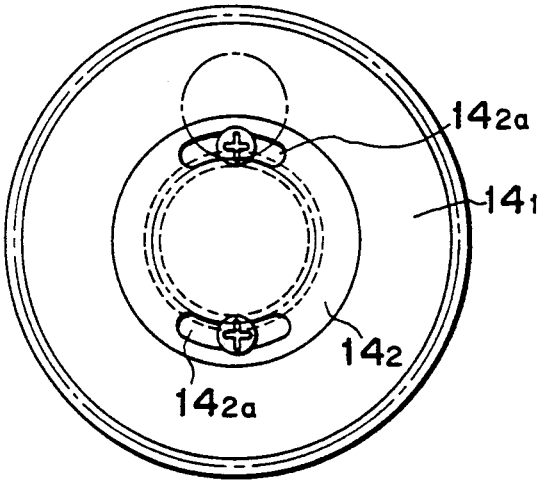
FIG. 4 is a side view of gear portions of the device of FIG. 3.

FIGS. 3 and 4 show a first embodiment of the present invention.

According to this embodiment, in a transfer drum 1B, idler gears 15'a and 15'b are fixedly mounted, by screws, on an idler shaft 16' to reduce the play in a rotational direction to the utmost. Further, the transfer drum gear 14 is divided into a larger diameter gear portion $14_1$ and a smaller diameter gear portion $14_2$. Two arcuate slots $14_{2a}$ extending along a circle which is concentric with the smaller diameter gear portion $14_2$ are formed in the latter, and the smaller diameter gear portion $14_2$ is adjustably fixed to the larger diameter gear portion $14_1$ by means of locking screws extending through the arcuate slots. Thus, the smaller diameter gear portion $14_2$ can be fixed to the larger diameter gear portion $14_1$ while adjusting the play in the rotational direction to a predetermined value.

With this arrangement, since the play in the rotational driving direction can be adjusted to the proper value, it is possible to reduce the deformation amount b of the connector member 1c and to eliminate the play in the rotational driving direction.

Figure 5:
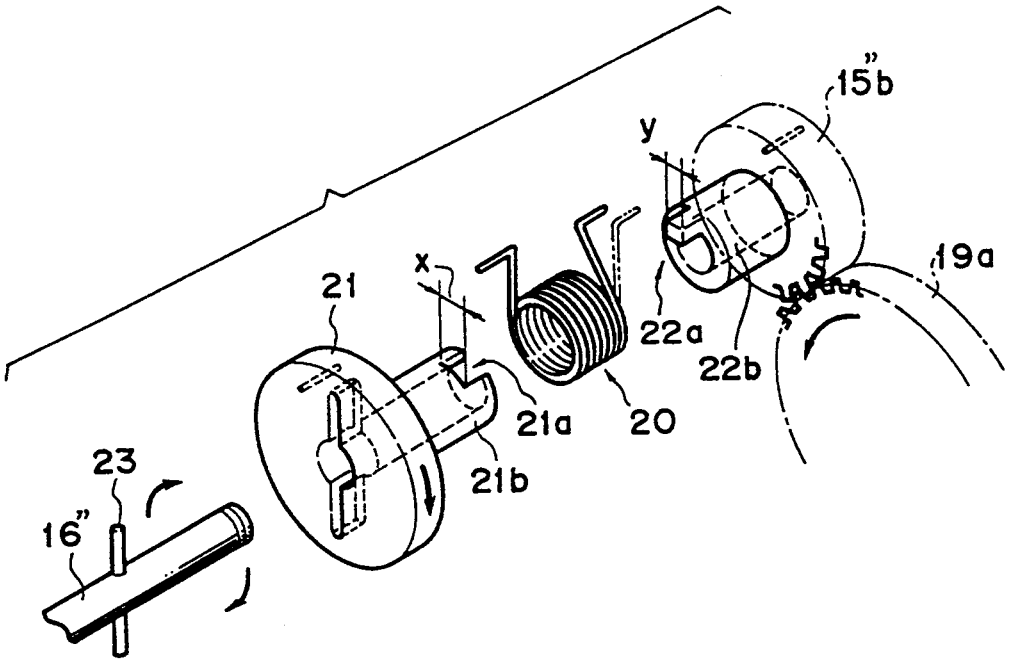
FIG. 5 is an exploded perspective view of a driving mechanism according to a second embodiment.

FIG. 5 shows a second embodiment of the driving force transmitting means for the transfer drum. In FIG. 5, only the driven idler portions of the driving force transmitting means are shown, and other portions are not shown because they are the same as those shown in other embodiments.

According to this embodiment, in the driven idler portions, a disc (to be fixed to a shaft) 21 is fixed to an idler shaft 16'' via a pin 23, and an idler gear 15''b is rotatably supported on the idler shaft 16'' and connected to the disc 21 through a torsion coil spring 20. Thus, the transmission of the driving force between the disc 21 and the idler gear 15''b is affected through the torsion coil spring 20. The deformation amount of the torsion coil spring 20 is regulated by the engagement (in the rotational direction) between a recess 21a formed in an end of a boss 21b of the disc 21 and a projection 22a formed on an end of a boss 22b of the idler gear 15''b.

Incidentally, a natural or non-deformed position of the torsion coil spring 20 is shown by a phantom line, and a position of the torsion coil spring after it is assembled into the device is shown by a solid line in FIG. 5.

With this arrangement, if the play (x−y) between the engaged recess 21a (of the disc 21) and projection 22a (of the idler gear 15''b) is set or selected to be larger than the total play of the driving force transmitting means for the transfer drum, i.e., the total play (z) from the transfer drum gear $14_1$ to the flange gear 19a (that is to say, if $(x-y)>z$), the play in the driving force transmitting means can be reduced to zero.

With this arrangement, it is possible to rotate the driven ring member 1b at exactly the same speed as the driving ring gear 1a. That is to say, it is possible to reduce the deformation amount of the connector member 1c to zero. Thus, both ring members 1a and 1b are rotated perfectly synchronous with each other, whereby the connector member 1c can be made of cheaper material having less strength and the area or volume of the connector member can be reduced. Incidentally, in this embodiment, it is desirable that the stored energy (F') of the torsion coil spring 20 after being assembled into the device is set or selected the same as the resistance force (F in FIG. 2) generated during the rotation of the ring member 1b (i.e., F=F').

Figure 6:
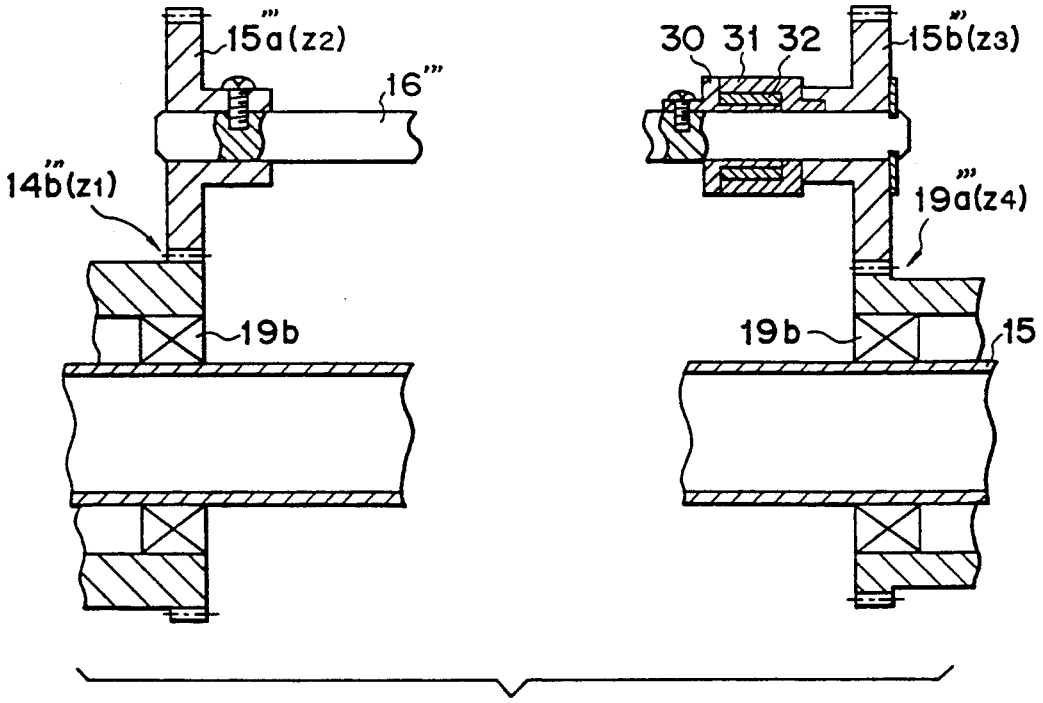
FIG. 6 is a sectional view of main portions of a driving mechanism according to a third embodiment.

FIG. 6 shows a third embodiment of a driving force transmitting means for the transfer drum according to the present invention. In FIG. 6, only parts associated with the driving force transmitting means are shown, and other parts are not shown because they are the same as those shown in other embodiments.

According to this embodiment, in the driven idler portions, a disc (to be fixed to a shaft) 30 is fixed to an idler shaft 16''' by a screw, and a joint portion 31 is integrally connected to an idler gear 15'''b through a recess and projection fitting connection, or integral formation. Further, the joint portion 31 and the disc 30 are made of magnetic material, and magnetic powder 32 is sealingly received between these elements 30 and 31, thereby forming a friction clutch (torque limiter) generating a sliding action when a predetermined rotation torque (F'') is applied as a load between the joint portion 31 and the disc 30.

Further, the relationship between a smaller diameter gear portion 14'''b (having the number of teeth of $Z_1$), flange gear 19'''a (having the number of teeth of $Z_4$), idler gear 15'''a (having the number of teeth of $Z_2$) and idler gear 15'''b (having the number of teeth of $Z_3$) is selected as follows:

$$Z_1=Z_2=Z_3>Z_4.$$

With this arrangement, when the smaller diameter gear portion 14''40 *b* is rotated by one revolution, the flange gear 19'''a tends to rotate by more than one revolution. However, because of the presence of the above-mentioned torque limiter, in effect, the gear elements 14'''b and 19'''a are rotated by the same revolutions.

In this case, since the smaller diameter gear portion 14'''b applies the force to the flange gear 19'''a in the rotational driving direction, the same advantage as that of the above second embodiment can be obtained.

Further, in this third embodiment, it is constructed that, when the idler gear 15'''a and the idler gear 15'''b are rotated by the same amount, the flange gear 19'''a is rotated by a further amount; thus, the present invention is not limited to the above relationship regarding the number of teeth. Further, the torque limiter is also not limited to the above-mentioned construction, but may be constituted by any type of friction plates and the like.

While the torsion coil spring as the biasing means in the second embodiment and the torque limiter in the third embodiment were arranged in the driven ring member side, they may be disposed in the driving ring member side.

Incidentally, unlike to the present invention, if the driving force transmitting means is disposed outside the transfer drum to rotate a gear having the same diameter as the ring member, the ring member is rotated by only small force, thereby generating the strain in the connector member. Thus, in this case, the idler shaft must have a sufficient strength, which results in increased cost of the apparatus. In addition, if the driving force transmitting means is disposed outside the transfer drum, the toner is apt to attach such means, which affects a bad influence upon the formation of the image. Further, a larger space is required.

Accordingly, the driving force transmitting means according to the present invention is preferably arranged inside the transfer drum.

I claim:

1. An image forming apparatus comprising:

an image forming means for forming an image on a recording medium at a recording position;

a rotatable recording medium bearing means for bearing the recording medium and for conveying the recording medium to said recording position;

a drive transmitting means for transmitting a driving force for conveying the recording medium to said recording medium bearing means;

an auxiliary transmitting means for transmitting said driving force in a direction of rotation of said recording medium bearing means;

wherein said auxiliary transmitting means is disposed inside said recording medium bearing means.

2. An image forming apparatus according to claim 1, further including an image bearing member for bearing a toner image.

3. An image forming apparatus according to claim 2, wherein said image forming means is a transfer means for transferring the toner image formed on said image bearing member onto said recording medium.

4. An image forming apparatus according to claim 3, wherein said recording position is disposed in a position where said image bearing member and said transfer means are opposed to each other.

5. An image forming apparatus according to claim 3, wherein the transfer of toner image is affected by superimposing a plurality of toner images on the same recording medium.

6. An image forming apparatus according to claim 5, wherein, after the transfer of toner image, a full-color toner image is formed on the recording medium.

7. An image forming apparatus according to claim 1, wherein said recording medium bearing means includes a flexible member comprising a dielectric sheet.

8. An image forming apparatus according to claim 2, wherein said drive transmitting means is said image bearing member.

9. An image forming apparatus according to claim 1 or 8, wherein the driving force from said drive transmitting means is transmitted to one of a pair of ring portions of said recording medium bearing means.

10. An image forming apparatus according to claim 1, wherein the driving force is transmitted from one end to the other end of said recording medium bearing means int he direction of rotation thereof.

11. An image forming apparatus according to claim 1, wherein said recording medium bearing means can bear a plurality of recording mediums simultaneously.

12. An image forming apparatus according to claim 1 or 10, wherein said recording medium bearing means includes first and second ring portions and a connection portion for connecting said first and second ring portions, and said auxiliary transmitting means transmits the driving force from said first ring portion to said second ring portion in the direction of rotation.

13. An image forming apparatus according to claim 12, wherein the position of said second ring portion relative to said first ring portion is adjustable.

14. An image forming apparatus according to claim 12, wherein said auxiliary transmitting means includes a transmitting member provided so as to extend from said first ring portion to said second ring portion.

15. An image forming apparatus according to claim 1, wherein said rotatable recording medium bearing means includes a flexible sheet and the recording medium is electrostatically attached to said flexible sheet.

16. An image forming apparatus comprising:

an image forming means for forming an image on a recording medium at a recording position;

a rotatable recording medium bearing means for bearing the recording medium and for conveying the recording medium to said recording position, said recording medium bearing means comprising first and second ring portions, a connector portion for interconnecting said first and second ring portions, and a flexible sheet for covering the space between these portions;

a first drive transmitting means for rotating said first ring portion;

a second drive transmitting means for transmitting a rotation force from said first ring portion to said second ring portion;

wherein said second drive transmitting means includes a biasing means for biasing the force in a rotation direction of said second ring portion.

17. An image forming apparatus according to claim 12, further including an image bearing member for bearing a toner image.

18. An image forming apparatus according to claim 17, wherein said image forming means is a transfer means for transferring the toner image formed on said image bearing member onto said recording medium.

19. An image forming apparatus according to claim 17, wherein said recording position is disposed in a position where said image bearing member and said transfer means are opposed.

20. An image forming apparatus according to claim 18, wherein the transfer of toner image is affected by superimposing a plurality of toner images on the same recording medium.

21. An image forming apparatus according to claim 18 or 20, wherein, after the transfer of the toner image, a full-color image is formed on the recording medium.

22. An image forming apparatus according to claim 16, wherein said flexible sheet comprises a dielectric sheet.

23. An forming apparatus according to claim 17, wherein said first drive transmitting means is said image bearing member.

24. An image forming apparatus according to claim 16, wherein the driving force is transmitted from one end to the other end of said recording medium bearing means in the direction of axis rotation axis thereof.

25. An image forming apparatus according to claim 16, wherein said recording medium bearing means can bear a plurality of recording mediums simultaneously.

26. An image forming apparatus according to claim 16 or 25, wherein said recording medium bearing means electrostatically attaches the recording medium to said flexible sheet.

27. An image forming apparatus according to claim 16, wherein said biasing means comprises a torsion coil spring.

28. An image forming apparatus according to claim 16 or 24, wherein said second drive transmitting means includes a transmitting member provided so as to extend from said first ring portion to said second ring portion.

* * * * *

UNITED STATES PATENT AND TRADEMARK OFFICE

CERTIFICATE OF CORRECTION

PATENT NO. : 5,081,488

DATED : January 14, 1992

INVENTOR(S) : HAJIME SUZUKI

It is certified that error appears in the above-identified patent and that said Letters Patent is hereby corrected as shown below:

COLUMN 1:

Line 23, "an" should read --a--.

COLUMN 2:

Line 2, "affected" should read --effected--;

Line 45, "affects" should read --effects--;

Line 55, "born" should read --borne--.

COLUMN 3:

Line 38, "born" should read --borne--.

COLUMN 4:

Line 56, "affects" should read --effects--.

COLUMN 5:

Line 37, "affected" should read --effected--.

UNITED STATES PATENT AND TRADEMARK OFFICE

CERTIFICATE OF CORRECTION

PATENT NO. : 5,081,488

DATED : January 14, 1992

INVENTOR(S) : HAJIME SUZUKI

It is certified that error appears in the above-identified patent and that said Letters Patent is hereby corrected as shown below:

COLUMN 6:

Line 29, "portion 14"40*b* " should read --portion 14"'*b*--;

Line 52, "to" should be deleted;

Line 61, "attach" should read --attach to--; and "affects" should read --effects--.

COLUMN 7:

Line 8, "means;" should read --means; and--;

Line 26, "affected" should read --effected--;

Line 45, "int he" should read --in the--.

UNITED STATES PATENT AND TRADEMARK OFFICE

CERTIFICATE OF CORRECTION

PATENT NO. : 5,081,488

DATED : January 14, 1992

INVENTOR(S) : HAJIME SUZUKI

It is certified that error appears in the above-identified patent and that said Letters Patent is hereby corrected as shown below:

COLUMN 8:

Line 15, "portion;" should read --portion; and--;

Line 34, "affected" should read --effected--;

Line 38, "18 or" should be deleted;

Line 43, "forming apparatus" should read --image forming apparatus--;

Line 49, "axis rotation axis" should read --rotation--.

Signed and Sealed this

First Day of June, 1993

Attest:

Michael K. Kirk

MICHAEL K. KIRK

Attesting Officer

Acting Commissioner of Patents and Trademarks